US009920660B2

(12) United States Patent
Kohrs et al.

(10) Patent No.: US 9,920,660 B2
(45) Date of Patent: Mar. 20, 2018

(54) CAMSHAFT ADJUSTER AND METHOD FOR OPERATING A CAMSHAFT ADJUSTER

(71) Applicant: Schaeffler Technologies AG & Co. KG, Herzogenaurach (DE)

(72) Inventors: Mike Kohrs, Oberreichenbach (DE); Jens Schäfer, Herzogenaurach (DE); Marco Hildebrand, Nuremburg (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 79 days.

(21) Appl. No.: 15/112,597

(22) PCT Filed: Dec. 9, 2014

(86) PCT No.: PCT/DE2014/200690
§ 371 (c)(1),
(2) Date: Jul. 19, 2016

(87) PCT Pub. No.: WO2015/117580
PCT Pub. Date: Aug. 13, 2015

(65) Prior Publication Data

US 2016/0333749 A1 Nov. 17, 2016

(30) Foreign Application Priority Data

Feb. 5, 2014 (DE) ..... 10 2014 202 060

(51) Int. Cl.

| | |
|---|---|
| ***F01L 1/344*** | (2006.01) |
| ***F01L 1/34*** | (2006.01) |
| ***F01L 1/352*** | (2006.01) |
| ***F01L 1/047*** | (2006.01) |
| *F01L 13/00* | (2006.01) |

(52) U.S. Cl.
CPC ..... *F01L 1/34* (2013.01); *F01L 1/047* (2013.01); *F01L 1/352* (2013.01); *F01L 1/34409* (2013.01); *F01L 2001/0473* (2013.01); *F01L 2013/103* (2013.01); *F01L 2250/02* (2013.01); *F01L 2250/04* (2013.01); *F01L 2820/032* (2013.01)

(58) Field of Classification Search
CPC ..... F01L 1/34409; F01L 2013/103; F01L 2820/032
USPC ..... 123/90.17
See application file for complete search history.

(56) References Cited

U.S. PATENT DOCUMENTS

2007/0056542 A1* 3/2007 Gregor ..... F01L 1/344 123/90.17

FOREIGN PATENT DOCUMENTS

| | | | |
|---|---|---|---|
| DE | 10054797 | A1 | 5/2002 |
| DE | 10248355 | A1 | 4/2004 |
| DE | 102004038695 | A1 | 2/2006 |
| DE | 102010039426 | A1 | 2/2012 |
| DE | 102011004071 | A1 | 8/2012 |
| DE | 102011004077 | A1 | 8/2012 |

(Continued)

*Primary Examiner* — Jorge Leon, Jr.
(74) *Attorney, Agent, or Firm* — Simpson & Simpson, PLLC

(57) ABSTRACT

A method for operating a camshaft adjuster, which includes an adjusting transmission with an input shaft, an output shaft connected in a non-rotatable manner with a camshaft, and an adjusting shaft, whereby the adjusting shaft is driven by an actuator, characterized by the fact that the actuator drives the adjusting shaft by overcoming a torque that is dependent on its angular position.

10 Claims, 4 Drawing Sheets

(56) References Cited

FOREIGN PATENT DOCUMENTS

| | | | |
|---|---|---|---|
| DE | 102012207318 | A1 | 11/2013 |
| EP | 2520772 | A2 | 11/2012 |
| WO | 2004/007917 | A1 | 1/2004 |

* cited by examiner

CAMSHAFT ADJUSTER AND METHOD FOR OPERATING A CAMSHAFT ADJUSTER

CROSS-REFERENCE TO RELATED APPLICATIONS

The present application is the U.S. national stage application pursuant to 35 U.S.C. § 371 of International Application No. PCT/ DE2014/200690, filed Dec. 9, 2014, which application claims priority from German Patent Application No. DE 10 2014 202 060.3, filed Feb. 5, 2014, which applications are incorporated herein by reference in their entireties.

TECHNICAL FIELD

The disclosure relates to a camshaft adjuster intended for use in an internal combustion engine as well as a method for the operation of a camshaft adjuster.

BACKGROUND

From DE 102 48 355 A1, we know of an electrically driven camshaft adjuster with an adjusting transmission which can be designed as a double eccentric transmission or a double planetary transmission. The adjusting transmission has low friction as well as a high reduction ratio of, for instance, 1:250.

From DE 10 2004 038 695 A1, we know of another camshaft adjuster which has an inner eccentric transmission or a planetary transmission as the adjusting transmission. A planetary transmission is also a part of a camshaft adjuster known from DE 100 54 797 A1, whereby in this case the adjustment can be done hydraulically or electrically. DE 10 2011 004 077 A1 discloses a shaft transmission that is suitable for a camshaft adjuster. In general, shaft transmissions for camshaft adjusters can be designed as pot type gears or flat gears. For a shaft transmission this is a three-shaft-transmission.

SUMMARY

The primary objective of the present disclosure forms the basis for further development of a camshaft adjuster that can be electrically driven as opposed to the state of the art, particularly with regard to energy aspects.

In the following, the designs elucidated in connection with the camshaft adjuster and the advantages of the present disclosure also apply mutatis mutandis for the operating procedure and vice versa.

The camshaft adjuster includes an adjusting transmission with an input shaft, an output shaft and an adjusting shaft, whereby the input shaft can be driven by means of a traction transmission from a crankshaft of an internal combustion machine and the output shaft is connected in a non-rotatable manner with the camshaft of the internal combustion machine. The adjusting shaft can be driven by an actuator which is preferably designed as an electric motor. A hydraulic actuator can also be used in place of the electric actuator. The adjusting transmission is preferably a three-shaft-transmission. Embodiments as four-shaft-transmissions are also feasible.

The torque required by the actuator for the rotation of the adjusting shaft is dependent on the angular position of the adjusting shaft. In an example embodiment, the drive torque required to be generated by the actuator fluctuates periodically, whereby one cycle of fluctuations of the drive torque extends to a little over half a revolution of the adjusting shaft. The fluctuations of the drive torque acting in the adjusting shaft can, for example, have a sinusoidal or a saw-toothed progression. Likewise, other periodically fluctuating drive torque progressions dependent on the angular position of the adjusting shaft are possible, which, for example, can be described—at least in approximation—by a polynomial or a trigonometric function.

Independent of the exact form of the curve, which is described by the progression of the drive torque acting between the actuator and the adjusting shaft, the torque goes preferably through at least two minima and maxima, but typically four or ten minima and maxima during a full rotation of the adjusting shaft of the load-free adjusting transmission.

The fluctuations of the torque acting on the adjusting shaft during the rotation of the adjusting shaft correspond to definite preferential positions of the output shaft in relation to the input shaft. The output shaft can be adjusted from a preferential position only with an increasing torque in both directions of rotation of the adjusting shaft. If the camshaft adjuster is in a preferential position, then this indicates an energetically particularly favorable position of the camshaft adjuster as compared to other positions of the output shaft. The advantage of the angular dependence of the torque required for the adjustment of the camshaft adjuster for transferring the torque from the actuator to the adjusting shaft thus lies in the fact that the camshaft adjuster can be kept in a preferential position with relatively less expenditure of energy.

The angle dependent fluctuations of the torque to be conveyed to the adjusting shaft go far beyond the possible torque fluctuations of conventional motor-transmission-layouts. In an example embodiment, the difference between the maximal and the minimal torque transferred from the actuator onto the adjusting shaft is at least 20% of the average torque acting on the adjusting shaft. Even a change of sign of the torque in the adjusting shaft during an adjustment in the same direction is possible. This is synonymous with the fact that the camshaft adjuster is automatically drawn into a preferential position. As soon as the camshaft adjuster is located in a preferential position, the energization of the actuator can stop.

The adjusting transmission of the camshaft adjuster is, for example, designed as a shaft transmission. A shaft transmission comprises an elastic, toothed component for a design as a pot transmission as well as for a flat transmission. In addition to this component there are, in an example embodiment, other components of the adjusting transmission that are designed at least slightly elastic and flexible. This can be a bearing ring of a rolling bearing in the adjusting transmission. The advantages of an elastic bearing ring become particularly pronounced if the corresponding rolling bearing has an even number of rolling elements.

Since, in a shaft transmission, the load maxima occur in diametrically opposite positions of a rolling bearing, there are on the corresponding positions of the bearing ring, thanks to the even number of rolling elements, always either two rolling elements or two gaps. The rolling bearing, which is part of a wave generator of an adjusting transmission that is designed as a shaft transmission, is pre-stressed in such a way that a deflection of the bearing rings takes place, which is dependent on whether the areas of maximum force application that are staggered at 180° to each other, lie in the circumferential section of the rolling bearing, in which the bearing rings are supported by rolling elements or are more easily flexible because of a gap between neighboring rolling elements. A milder flexing corresponds to a more easily rotatable adjusting shaft. In an example embodiment, the minima of the torque progression are shaped as locking positions.

In an example embodiment, significant torque fluctuations during the operation of the camshaft adjuster are taken care of by a bearing ring, particularly an outer ring of a rolling bearing that functions as a component of a wave generator, which is so thin walled that it is elastic and flexible and thus creates a locking effect. Alternatively, an inner ring or a shaft of the rolling bearing that is in contact with the rolling element can be designed wavy around the circumference.

Likewise, it is possible that at least one bearing ring of the rolling bearing has a varying wall thickness around its circumference. A targeted reduction of the radial stiffness of the rolling bearing can also be achieved by holes below the raceway of the rolling element.

A locking effect of a rolling bearing in the adjusting transmission is also possible by the use of rolling elements whose cross section deviates from the circular. For example, non-round rollers or needles can have a slightly elliptical or polygonal cross section. Likewise, different rolling elements that have diameters slightly different from each other can be used inside the roller bearing. For example, in the peripheral direction of the rolling bearing, two smaller rolling elements and one bigger rolling element can alternate.

The adjusting transmission of the camshaft adjuster has a high reduction ratio which, even for coarse locking positions of the adjusting shaft, provides multiple fine locking positions of the output shaft in relation to the angular position of the input shaft. In an example embodiment, there are at least 30 locking positions of the output shaft. The output shaft can therefore be held in several positions, namely preferential positions, between its mechanical end stops, whereby for the holding of the output shaft, that is, for the fixation of the camshaft in relation to the crankshaft, at the most a small torque needs to be applied through the actuator. Whereas the actuator in certain positions is at least load-free to a large extent, the output shaft to a very large extent, or completely, is held by resistances within the adjusting transmission.

This kind of independent fixation of a transmission output element principally also exists with every self-locking transmission. The adjusting transmission of the camshaft adjuster however differs from this basically by the fact that the automatic fixation of the output shaft of the transmission is available only in individual angular positions. The mean torque which is required for the adjustment of the camshaft adjuster is, on the other hand, distinctly lower than that for a self-locking transmission. Accordingly, the efficiency of the adjusting transmission in accordance with the present disclosure lies above 50%, which is not the case in a self-locking transmission.

The adjusting transmission being used in the camshaft adjuster is also designated as a quasi-self-locking transmission or a transmission with latched self-locking effect. It combines the advantages of a self-locking transmission, namely the automatic holding of a transmission output element with the substantial advantage of a non-self-locking transmission, namely the significantly higher efficiency when compared to a self-locking transmission.

Independent of the type of construction of the adjusting transmission, the torque required for the rotation of the adjusting shaft is preferably, at least in a narrow limited angular region, that which corresponds to a preferred position, significantly lower than for a conventional, electrically operated camshaft adjuster, even if this—as usual—has a non-self-locking transmission. In contrast, a torque can be applied in an angular region between two selective, or nearly selective, preferential positions, which is greater than the torque required for the actuation of a conventional camshaft adjuster and lies in, or even above, an order of magnitude that is typical for a self-locking transmission. Due to the averaging of the torque during the adjustment procedure and due to fact that the camshaft adjuster during a greater part of its operational service life, is operated in one of the several preferential positions, the energy requirement of the camshaft adjuster when compared to the state of the art is finally substantially reduced.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Parts principally corresponding to each other or parts with the same effect are marked with the same reference sign in all the figures.

Figure 2:
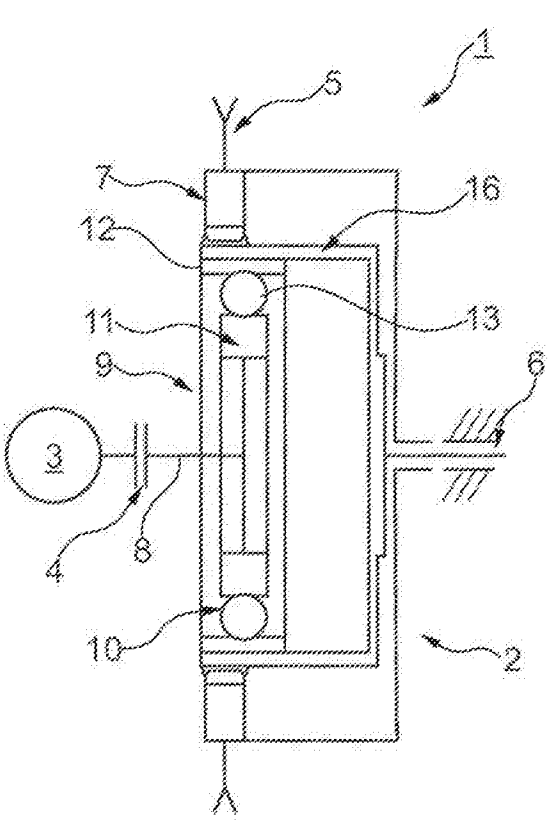
FIG. 2 is a schematic view of a second example embodiment of a camshaft adjuster with a shaft transmission.
Figure 1:
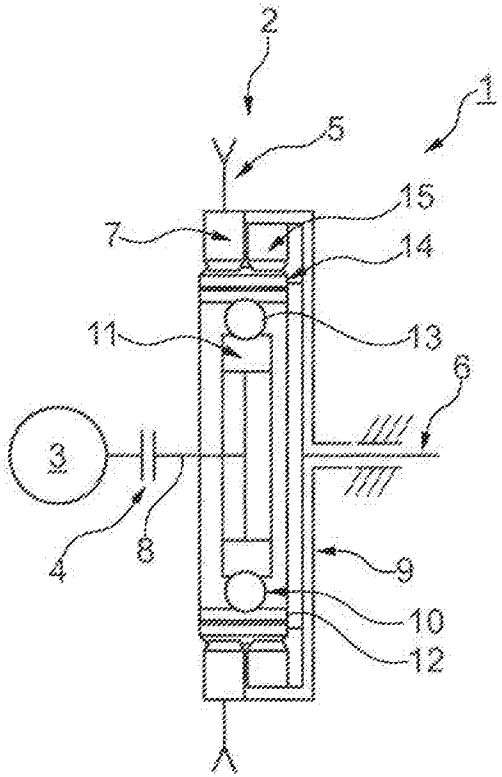
FIG. 1 is a schematic view of a first example embodiment of a camshaft adjuster with a shaft transmission.

FIGS. 1 and 2 show, greatly simplified, an embodiment of a suitable electrically driven camshaft adjuster 1 for use in an internal combustion machine, particularly in a gasoline spark ignition engine, with regard to its principal function on the state-of-the-art referenced at the outset.

Camshaft adjuster 1 includes adjusting transmission 2 as well as actuator 3, namely an electric motor, whereby in the design examples coupling 4 is inserted between actuator 3 and adjusting transmission 2. Adjusting transmission 2 is designed as a shaft transmission in the design example as per FIG. 1 as well as in the design example as per FIG. 2. In both cases chain sprocket 5 serves as a drive element of camshaft adjuster 1, whereas output shaft 6 of adjusting transmission 2 is firmly connected to a camshaft that is not depicted in the figures. In place of chain sprocket 5, in case of a belt driven camshaft, there could be a belt pulley. Internal input gear 7 is connected to chain sprocket 5, which constitutes input shaft 7 of adjusting transmission 2. Adjusting shaft 8, as a third shaft of adjusting transmission 2, can be driven by actuator 3 over coupling 4. As long as adjusting shaft 8 rotates with the rpm of input shaft 7, output shaft 6 also rotates with this rpm.

The angular relation between the camshaft and the crankshaft of the internal combustion machine in this operating status remains unchanged. An adjustment of the camshaft takes place when actuator 3 drives adjusting shaft 8 with an rpm that is different from the rpm of chain sprocket 5. In each of the embodiments included in FIG. 1 and FIG. 2, adjusting transmission 2 involves a high ratio transmission, so that a change of the angular relation between adjusting shaft 8 and input shaft 7 by a particular amount leads to a change of the angular relation between input shaft 7 and chain sprocket 5 on the one hand and output shaft 6 on the other by a much smaller amount.

Adjusting shaft 8 is meant for the activation of wave generator 9. Wave generator 9 includes rolling bearing 10, which is elliptically shaped (not shown in FIGS. 1 and 2). Here, there is inner ring 11 of rolling bearing 10 that is elliptically shaped, while a relatively thin walled outer ring 12 adjusts itself to the shape of inner ring 11. Balls roll as rolling elements 13 between inner ring 11 and outer ring 12.

In the design of the first embodiment of adjusting transmission 2 according to FIG. 1, spur gear 14 is directly on outer ring 12, which is likewise deformable and has the same width measured in the axial direction as outer ring 12.

The external tooth arrangement of spur gear 14 meshes with the inner tooth arrangement of internal input gear 7, whereby this barely takes up half the width of spur gear 14. The inner tooth arrangement of spur gear 14 and of internal input gear 7, engage into each other only at two places oriented at 180° from each other, in the upper and lower area of adjusting transmission 2. In all remaining angular areas spur gear 14 is lifted from internal input gear 7 because of the elliptical shape of rolling bearing 10.

Similarly, spur gear 14 acts together with internal output gear 15 which is arranged with a small clearance axially near internal input gear 7 and is also toothed on the inside. Due to the difference in the number of teeth of internal input gear 7 and internal output gear 15, internal output gear 15 is slightly staggered in relation to internal input gear 7 after one full revolution of inner ring 11. As an example, the number of teeth of internal input gear 7 differs from those of internal output gear 15 by two. Internal output gear 15 is firmly connected to output shaft 6.

The second embodiment shown in FIG. 2 with regard to the basic kinematics corresponds to the first embodiment shown in FIG. 1, whereby in the second embodiment, in place for spur gear 14 and internal output gear 15, a single pot shaped output gear 16 which is connected to output shaft 6 is provided. Output gear 16 has outer tooth arrangement that meshes with the inner tooth arrangement of internal input gear 7, the number of teeth of which differs slightly from the number of teeth of the inner tooth arrangement of internal input gear 7, for instance by two. Output gear 16, at least in the region of the toothing, is elastic enough to be deformed by wave generator 9.

Figure 3:
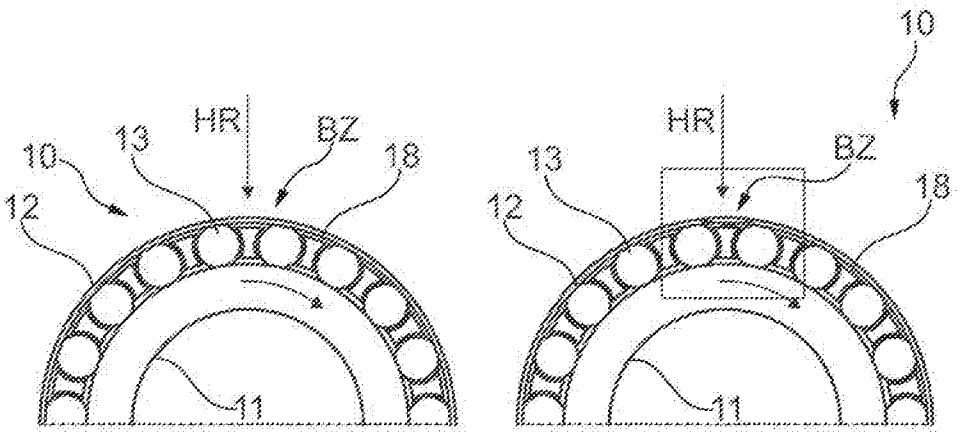
FIG. 3 is a front partial view of a rolling bearing for a shaft transmission.

FIG. 3 shows rolling bearing 10 in different states, which can be used as components of wave generator 9 in both the first and second embodiments. A main direction of loading HR in which a force acts on rolling bearing 10 is symbolized by an arrow pointing in the radial direction. The direction of rotation of inner ring 11 that is driven by actuator 3 is indicated by an arrow pointing in the circumferential direction. In the left arrangement of rolling bearing 10 in FIG. 3, there is a flow of force from internal input gear 7 to inner ring 11 straight through rolling element 13. A deformation of thin walled outer ring 12 which is pressed directly on rolling element 13 through the tooth arrangement of internal input gear 7, is practically not possible in this arrangement.

Figure 4:
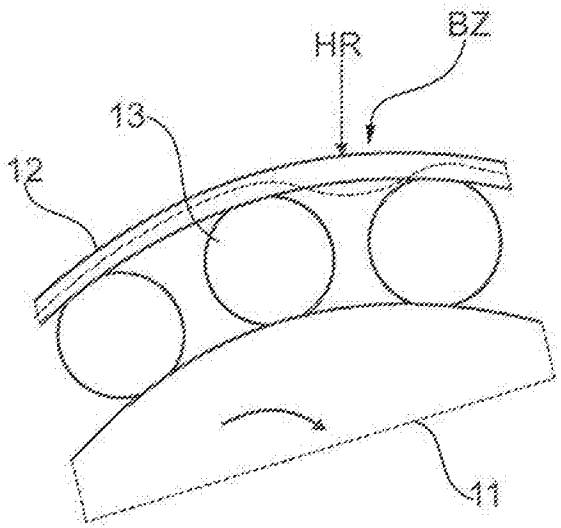
FIG. 4 is an enlarged detail view of the rolling bearing shown in FIG. 3.

In the right arrangement of rolling bearing 10 in FIG. 3, inner ring 11 is rotated so much that the force acting in the main direction of loading HR is directed midway between two neighboring rolling elements 13. Because of the thin walled construction of outer ring 12, it is deformed in the relevant region, as indicated in FIG. 4 by a dashed line. The loading zone of outer ring 12 in which the deformation is intended is marked BZ. The deflection of outer ring 12 in loading zone BZ, as long as this lies between two rolling elements 13, creates a locking effect of adjusting transmission 2. Since output shaft 6 of the camshaft adjuster rotates several times slower than adjusting shaft 8 and adjusting shaft 8 can already take up multiple locking positions, namely a number corresponding to the number of rolling elements 13, output shaft 6 can be locked extremely fine.

Figure 5:
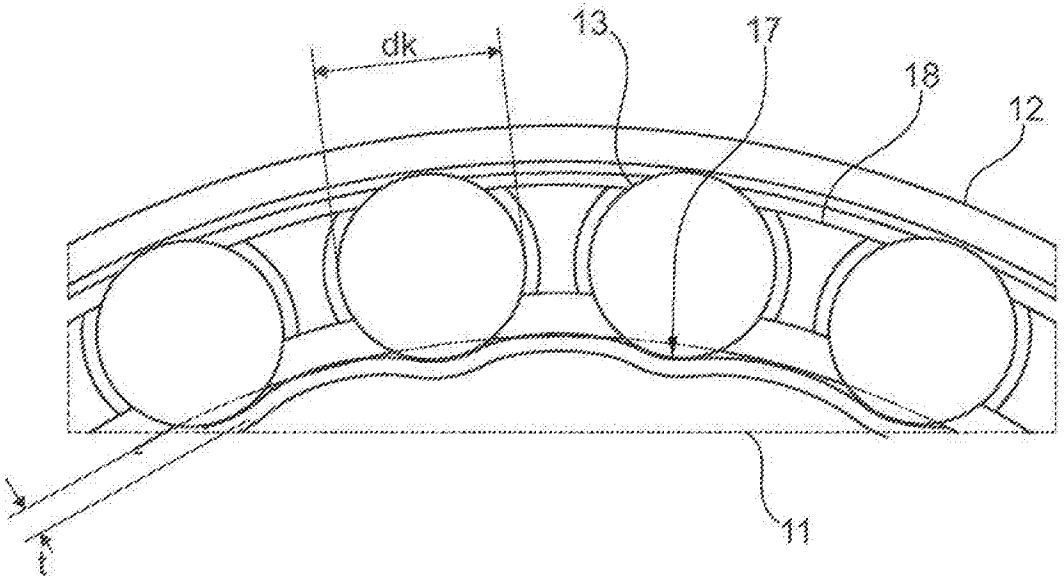
FIG. 5 is an example embodiment of a rolling bearing for a shaft transmission of a camshaft adjuster; and, FIG. 6 is a graph of a torque curve in an adjusting shaft during the activation of a camshaft adjuster.

FIG. 5 is an example embodiment of rolling bearing 10 of adjusting transmission 2 which can also be used in both the first and second embodiment of the camshaft adjuster 1. Hereby, a locking effect of rolling bearing 10 is created by a non-round design of inner ring 11. Inner ring 11 has a number of flat spots 17 on its circumference equal to the number corresponding to rolling elements 13, on which the surface of inner ring 11, based on the basic cylindrical form, is recessed by depth t. Depth t is between 0.2% and 20% of the rolling element diameter marked as dk. Furthermore in FIG. 5, cage 18 meant as a guide for rolling element 13 can be seen. In an example embodiment rolling elements 13 are balls. Alternatively, needles or cylindrical rollers can be used as rolling elements for the rolling bearings.

Figure 6:
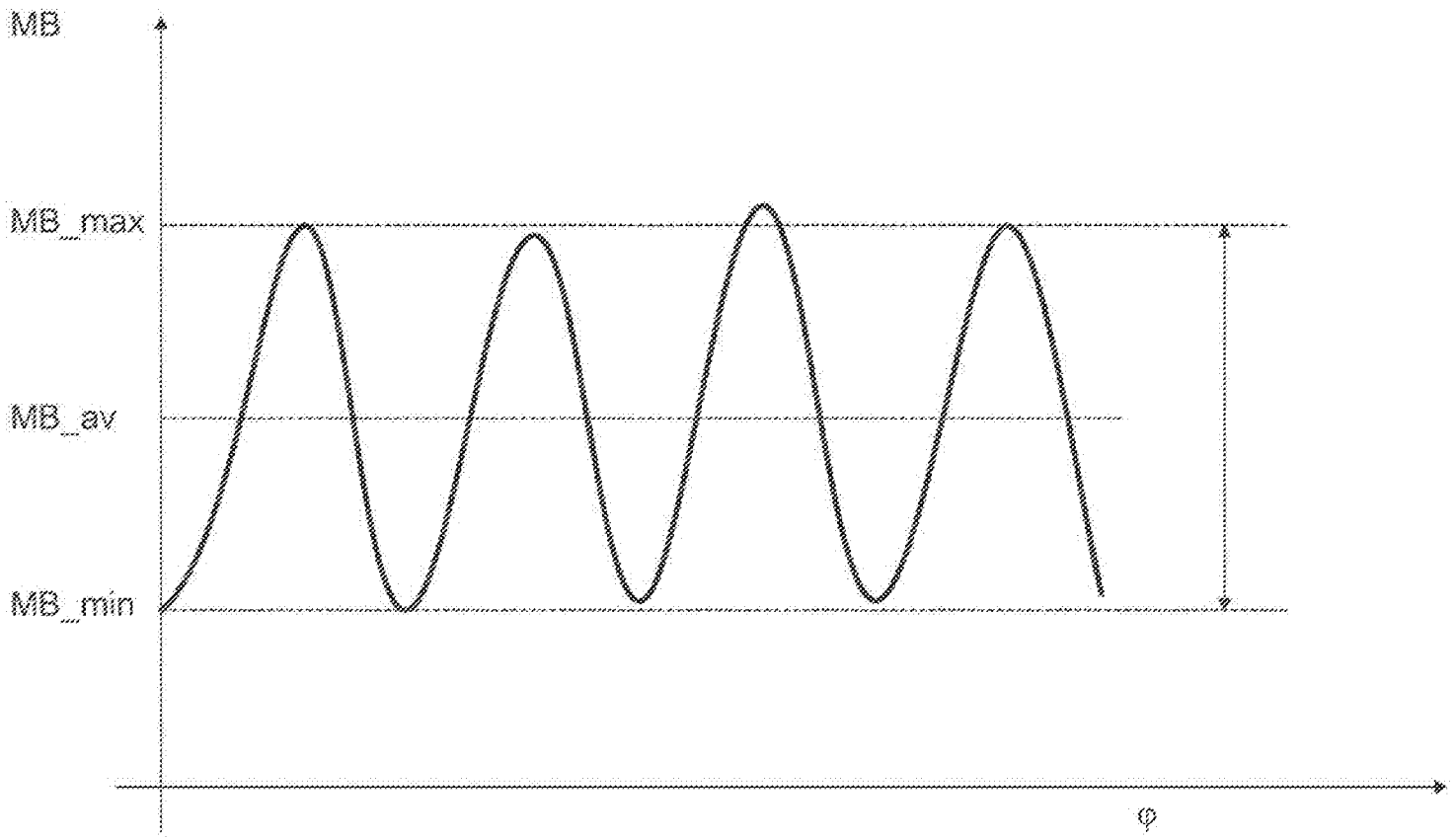

FIG. 6 is a graph indicating the progression of the torque acting in adjusting shaft 8 during the activation of camshaft adjuster 1. The torque graph of FIG. 6 applies to the embodiments of rolling bearing 10 shown in FIGS. 3 and 4 as well as to the embodiment shown in FIG. 5. Depicted is the dependence of the torque, referred to as acting torque ME acting in adjusting shaft 8, on its angular position, whereby angle marked as φ in the diagram in FIG. 6 covers several cycles of fluctuating torque. As in FIG. 6, activating torque MB progresses approximately sinusoidal; a mean activating torque is designated MB_av, a minimal activating torque MB_min and a maximal activating torque MB_max. The minima of the curve plotted in FIG. 6 correspond to the depicted status of rolling bearing 10 shown in FIG. 4. Output shaft 6 as well as input shaft 7, are in a preferential position in which they can be held with minimal expenditure of energy by actuator 3.

In general, the co-relation between torque MB acting on input shaft 7 and output torque designated MA acting on output shaft 6 can be described as follows:

$$MB(\varphi)=MA/(i_BA\times eta(\varphi))$$

where i_BA is designated as the transmission ratio of adjusting transmission 2 and transmission factor eta which is dependent on angle φ. The angle dependent fluctuation of transmission factor eta reflects in the oscillating curve depicted in FIG. 5. For a transmission whose transmission properties are not dependent on the angular position of the input and output shafts, it would be appropriate to replace eta (φ) with an efficiency factor that is not dependent on the angle. In the case of adjusting transmission 2 of camshaft adjuster 1, the mean value of transmission factor eta averaged over all angles φ is greater than 0.5. Adjusting transmission 2 must therefore not be classified as a self-locking transmission.

If the curve, plotted as a function of angle φ of adjusting shaft 8, describing an approximately harmonic oscillation, which specifies activating torque MB required for rotating adjusting shaft 8 in deviation from FIG. 6 into the negative region, then this indicates that adjusting shaft 8 is drawn automatically into the preferential positions, whereby the average activating torque MB_av is positive also in this case. An energization of actuator 3 in this arrangement is only required for adjusting output shaft 6 connected to the camshaft, from one locking point into another. The number of locking points or preferential positions results from the number of revolutions required for adjusting output shaft 6 from one end-stop to a second end-stop, multiplied by the number of rolling elements 13 of rolling bearing 10.

If the transmission ratio i_BA is, for example, 90 and the rotation angle between the end-stops of output shaft 6 is exactly 60°, i.e. one sixth of a full revolution, then adjusting shaft 8 must be rotated by 90/6=15 rotations to go from one end-stop to the second end-stop. If rolling bearing 10 of wave generator 9, as drawn in FIG. 3, has eighteen rolling elements 13, whereby between two neighboring rolling elements 13 there is always a preferential position of adjusting shaft 8, then there are during the 15 revolutions in all 15×18 =270 preferential positions that distribute themselves uniformly over the said 60° wide adjusting region of output shaft 6.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMBERS LIST

BZ Load zone
dk Rolling element diameter
eta Transmission factor
HR Main direction of loading
i_BA Transmission ratio
MA Output torque
MB Activating torque, torque
MB_av Average activating torque
MB_min Minimum activating torque
MB_max Maximum activating torque
t Depth
φ Angle
1 Camshaft adjuster
2 Adjusting transmission
3 Actuator
4 Coupling
5 Chain sprocket
6 Output shaft
7 Input shaft, internal input gear
8 Adjusting shaft
9 Wave generator
10 Rolling bearing
11 Inner ring
12 Outer ring
13 Rolling element
14 Spur gear
15 Internal output gear
16 Output gear
17 Flat spot
18 Cage

What is claimed is:

1. A camshaft adjuster, comprising:
an adjusting transmission, comprising:
an input shaft;
a camshaft; and,
an output shaft non-rotatably connected to said camshaft; and,
an adjusting shaft, wherein an actuator drives said adjusting shaft by overcoming a torque that is dependent on an angular position of said adjusting shaft.

2. The camshaft adjuster as recited in claim 1, wherein said torque transmitted by said actuator to said adjusting shaft fluctuates periodically, whereby a cycle of fluctuations of said torque extends for less than half a revolution of said adjusting shaft.

3. The camshaft adjuster as recited in claim 2, wherein for a full revolution of said adjusting shaft of the adjusting transmission when load-free, said torque acting between said actuator and said adjusting shaft goes through at least two minima and maxima.

4. The camshaft adjuster as recited in claim 1, wherein during an adjustment said torque has an alternating sign and acts in a same direction between said actuator and said adjusting shaft.

5. The camshaft adjuster as recited in claim 1, wherein a difference between a maximum torque acting between said actuator and said adjusting shaft and a minimum torque acting between said actuator and said adjusting shaft corresponds to at least 20% of an average torque acting between said actuator and said adjusting shaft.

6. A camshaft adjuster, comprising:
an adjusting transmission, comprising,
an input shaft;
a camshaft; and,
an output shaft non-rotatably connected to said camshaft;
an adjusting shaft, wherein a plurality of positions of said output shaft allow said output shaft to be adjustable with a torque that is incremental in a first direction and a second direction; and,
an actuator operatively arranged to transfer an angle-dependent variable torque to said adjusting shaft.

7. The camshaft adjuster as recited in claim 6, wherein said adjusting transmission is a shaft transmission.

8. The camshaft adjuster as recited in claim 7, wherein said adjusting transmission further comprises a rolling bearing with an even number of rolling elements.

9. The camshaft adjuster as recited in claim 8, wherein said rolling bearing of said adjusting transmission has a varying geometrical design along a respective circumference.

10. The camshaft adjuster as recited in claim 6, wherein said plurality of positions of said output shaft are locking positions in which said output shaft remains without torque from said actuator.

* * * * *